US009415590B2

(12) United States Patent
Barton et al.

(10) Patent No.: US 9,415,590 B2
(45) Date of Patent: Aug. 16, 2016

(54) ELECTROHYDRODYNAMIC JET PRINTING DEVICE WITH EXTRACTOR

(71) Applicant: The Regents of the University of Michigan, Ann Arbor, MI (US)

(72) Inventors: Kira Barton, Ann Arbor, MI (US); Tse Lai Yu Leo, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 0 days.

(21) Appl. No.: 14/263,915

(22) Filed: Apr. 28, 2014

(65) Prior Publication Data

US 2014/0322451 A1 Oct. 30, 2014

Related U.S. Application Data

(60) Provisional application No. 61/816,423, filed on Apr. 26, 2013.

(51) Int. Cl.

| | |
|---|---|
| ***B05B 5/025*** | (2006.01) |
| ***B05C 5/00*** | (2006.01) |
| ***B05D 1/00*** | (2006.01) |
| ***B41J 2/06*** | (2006.01) |
| *B05B 5/03* | (2006.01) |
| *B05B 5/16* | (2006.01) |

(52) U.S. Cl.

CPC ..... *B41J 2/06* (2013.01); *B05B 5/0255* (2013.01); *B05B 5/03* (2013.01); *B05B 5/1608* (2013.01); *B05C 5/00* (2013.01)

(58) Field of Classification Search

None

See application file for complete search history.

(56) References Cited

U.S. PATENT DOCUMENTS

| | | | | |
|---|---|---|---|---|
| 5,502,472 | A * | 3/1996 | Suzuki | 347/69 |
| 6,312,110 | B1 | 11/2001 | Darty | |
| 2009/0233057 | A1 | 9/2009 | Aksay et al. | |
| 2012/0205528 | A1 * | 8/2012 | Augustyniak et al. | 250/231.13 |

OTHER PUBLICATIONS

B. De Gans et al., "Inkjet Printing of Polymers: State of the Art and Future Development," Advanced Materials, vol. 16, No. 3, 2004, pp. 203-213.

R. Parashkov et al., "Large Area Electronics Using Printing Method," Proceeding of the IEEE, vol. 93, No. 7, 2005, pp. 1321-1329.

J. Szczech et al., "Fine-Line Conductor Manufacturing Using Drop-On-Demand PZT Printing Technology," IEEE Transactions on Electronics Packaging Manufacturing, vol. 25, No. 1, 2002, pp. 26-33.

(Continued)

*Primary Examiner* — Dah-Wei D Yuan
*Assistant Examiner* — Jethro M Pence
(74) *Attorney, Agent, or Firm* — Reising Ethington P.C.

(57) ABSTRACT

A printing device includes a nozzle and an extractor. An electrostatic extraction field is generated at the extractor and at a discharge opening of the nozzle to extract polarized ink from the nozzle for deposition on a printing substrate. The extractor includes an electrically conductive portion for application of one side of a voltage potential to generate the electrostatic field. The extractor can be in the form of an extractor plate with an opening through which the extracted ink passes, or the extractor can be in the form of another nozzle. The printing device provides a directionality field that affects the trajectory of the extracted ink. The directionality field can include the electrostatic field or a gas flow field. The printing device is useful for electrohydrodynamic jet, or e-jet, printing on a non-conductive substrate.

18 Claims, 12 Drawing Sheets

(56) References Cited

OTHER PUBLICATIONS

H. Le, "Progress and Trends in Ink-jet Printing Technology," Journal of Imaging Science and Technology, 42: 49-62, 1998.
P. Calvert, "Inkjet Printing for Materials and Devices," Chem Mater, vol. 13, pp. 3299-3305.
G. Whitesides et al., "Soft Lithography in Biology and Biochemistry," Annu. Rev. Biomed. Eng. vol. 3, pp. 335-373.
M. Unger et al., "Monolithic Microfabricated Valves and Pumps by Multilayer Soft Lithography," Science, 288, pp. 113-116.
Owa S. et al., "Immersion Lithography; Its Potential Performance and Issues," Proceedings of SPIE, vol. 5040, 2003, pp. 724-733.
T. Ito et al., "Pushing the Limits of Lithography," Nature, vol. 406, 2000, pp. 1027-1031.
H. Schift, "Nanoimprint Lithograpghy: An Old Story in Modern Times? A Review," Journal of Vacuum Science & Technology B, vol. 26, 2008, pp. 458-480.
J. Park et al., "High-Resolution Electrohydrodynamic Jet Printing," Nature Materials, vol. 6, 2007, pp. 782-789.
M. Poellmann et al., "Patterned Hydrogel Substrates for Cell Culture with Electrohydrodynamic Jet Printing," Macromolecular Bioscience vol. 11, 2011, pp. 1164-1168.
K. Barton et al., "A Desktop Electrohydrodynamic Jet Printing System," Mechatronics, vol. 20, 2010, pp. 611-616.
K. Barton et al., "Control of High-Resolution Electrohydrodynamic Jet Printing," Control Engineering Practice vol. 19, 2011, pp. 1266-1273.
S. Mishra et al., "High Speed Drop-On-Demand Printing with a Pulsed Electrohydrodynamic Jet," Journal of Micromechanics Microengineering, vol. 20, 2010, pp. 1-8.
S. Jayasinghe et al., "Electrohydrodynamic Jet Processing: An Advanced Electric-Field-Driven Jetting Phenomenon for Processing Living Cells," Small, vol. 2, No. 2, 2006, pp. 216-219.
J. Park et al., "Nanoscale Patterns of Oligonucleotides Formed by Electrohydrodynamic Jet Printing with Applications in Biosensing and Nanomaterials Assembly," Nano Letters, vol. 8, No. 12, 2008, pp. 4210-4216.
D. Lee et al., "Electrohydrodynamic Printing of Silver Nanoparticles by Using a Focused Nanocolloid Jet," Applied Physics Letters, vol. 90, 2007, pp. 1-4.
E. Sutanto et al., "A Multimaterial Electrohydrodynamic Jet (E-jet)Printing System," Journal of Micromechanics and Microengineering, vol. 22, pp. 1-11.
E. Sutanto et al., "A High Throughput Electrohydrodynamic Jet System," Proceedings of the ASME/ISCIE 2012 International Symposium on Flexible Automation, ISFA2012-7131, Jun. 2012, St. Louis, MO, pp. 1-7.
Tse et al., "A Field Shaping Printhead for High-Resolution Electrohydrodynamic Jet Printing Onto Non-Conductive and Uneven Surfaces," Applied Physics Letters 104, 143510, 2014.

* cited by examiner

ELECTROHYDRODYNAMIC JET PRINTING DEVICE WITH EXTRACTOR

CROSS-REFERENCE TO RELATED APPLICATION

This application claims the benefit of U.S. Provisional Application No. 61/816,423, filed Apr. 26, 2013, the entire contents of which are hereby incorporated by reference.

TECHNICAL FIELD

This invention relates generally to structures and methods for printing and, more specifically, for electrohydrodynamic jet printing.

BACKGROUND

Processes such as ink jet printing and lithography are used to fabricate a wide range of electronics and bio-sensors at the micro- and nano-scale (μ/n-scale). Despite advancements in these processes over time, they are not always able to meet certain performance requirements (e.g. resolution, material diversity, or process flexibility) and/or cost requirements (e.g. material use or cycle time), particularly in emerging applications in biotechnology and flexible electronics.

Ink jet printing has seen rapid development in the past few decades. Some ink jet systems are able to provide high throughput (e.g., 50-175 kHz jetting frequency) at low system costs. Printing processes are generally considered to be environmentally friendly processes as applied to device fabrication since they are additive processes that produce minimal waste. But the nozzle diameter of a typical ink jet print head, such as a thermally actuated bubble jet system print head, is about 20-30 μm, resulting in a print resolution that is too coarse for micro-scale applications. Some ink jet print systems use piezoelectric materials to generate mechanical waves that eject ink droplets from the nozzle. But the mechanical vibration of the nozzle can limit the accuracy of such systems, rendering them unable to meet the tight resolution requirements of μ/n-scale applications. The types of ink materials that can be used in thermal- and piezoelectric-actuated ink jet systems is also somewhat limited by nozzle clogging issues and the need to withstand exposure to the temperatures used in thermal actuation.

Lithography processes have proven capable in mass manufacturing and in some μ/n-scale manufacturing applications, but are not able to provide the flexibility, material diversity, and cost effectiveness required for all μ/n-scale manufacturing applications, particularly in new and emerging applications. Optical lithography employs an etching process to produce a specific pattern determined by a pre-designed mask. While highly accurate, this process is not suitable for biological materials or electro-optical components that are susceptible to the aggressive materials used in the etching process. The masking requirement also makes photolithography less flexible than printing processes, not to mention more time consuming and costly. Nanoimprint lithography can achieve high resolution and accuracy, demonstrates high throughput at a low cost for mass production, is compatible with many materials, and can create 3D structures at the nano-scale. However, nanolithography also requires a mask and is thus less flexible than printing processes. Lithography processes can also be relatively complex, often including multiple steps for fabrication, and is generally not considered environmental friendly, as etching away material necessarily includes material waste.

Electrohydrodynamic jet printing, also known as e-jet or EHD printing, is a type of printing that has shown promise for use in printed electronics and bio-sensor applications. A typical e-jet printing process relies on an electrostatic field between a conductive nozzle and a conductive substrate to extract a printing fluid from the nozzle without the increased temperatures or mechanical vibrations associated with thermal- and piezoelectric-actuated ink jet printing. E-jet printing has been somewhat limited by low product throughput and the requirement for a conductive substrate to generate the necessary electrostatic field. Process sensitivity has also plagued e-jet printing. For example, nozzle-to-substrate distance can be a critical parameter affecting the generated ink-extraction field, thus generally limiting the process to flat substrates. Additionally, once a layer of non-conductive ink is deposited onto the conductive substrate, the character of the generated electrostatic field is changed, greatly limiting the use of e-jet printing in 3D-printing applications.

SUMMARY

An embodiment of a printing device includes a nozzle and an extractor. The nozzle has a discharge opening and is configured to provide polarized printing fluid at the discharge opening. The extractor is configured to provide an electrostatic field at the discharge opening that extracts the polarized printing fluid from the nozzle through the discharge opening for deposition on a printing substrate in response to an applied voltage. The nozzle and the extractor are configured to move together with respect to the printing substrate.

An embodiment of a method of printing comprises the steps of: (a) applying a voltage across two components of a print head to generate an electrostatic extraction field between the two components sufficient to extract polarized printing fluid from a nozzle of the print head; and (b) providing a directionality field to propel the extracted printing fluid toward a printing substrate.

An embodiment of the printing device includes a first nozzle and a second nozzle. The first nozzle has a discharge opening and is configured to provide polarized printing fluid at the discharge opening. The second nozzle has a gas discharge port in fluid communication with a pressurized fluid flow passage to provide a gas flow field at the gas discharge port. The nozzles are arranged to provide an electrostatic field at the discharge opening that extracts the polarized printing fluid from the first nozzle and into the gas flow field for deposition on a printing substrate when a voltage potential is applied across the nozzles.

BRIEF DESCRIPTION OF THE DRAWINGS

Illustrative embodiments will hereinafter be described in conjunction with the appended drawings, wherein like designations denote like elements, and wherein.

DESCRIPTION OF THE ILLUSTRATED EMBODIMENTS

Figure 1:
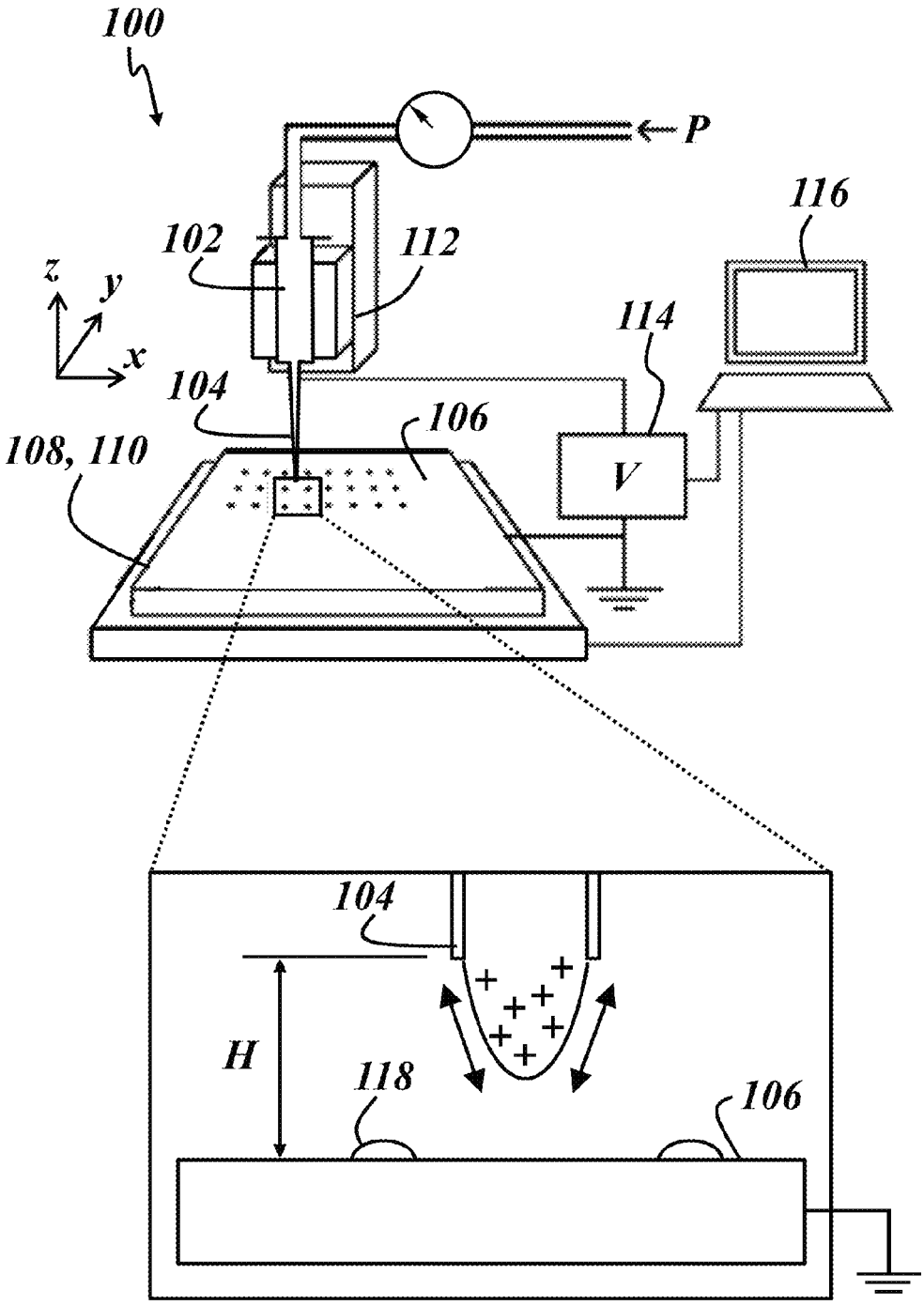
FIG. 1 is a schematic view of an e-jet printing system that requires a conductive substrate.

FIG. 1 illustrates an example of an e-jet printing system 100. The illustrated system includes an ink chamber 102, a pressure source to maintain the ink chamber at a positive pressure P, a conductive nozzle 104, a conductive substrate 106, x-, y-, and z-translational stages 108-112 for moving the substrate and nozzle relative to each other, a high voltage power supply 114, and a computer controller 116. As used herein, the term "ink" refers to any printing fluid intended for deposition on a printing substrate in some desired pattern. Some non-limiting examples of suitable printing fluids include aqueous and/or organic solvent-borne pigments or dyes, metals, molten metals, polymers, biological materials, and particles suspended in aqueous and/or organic solvents. Other materials that can be transformed to a polarized fluid (e.g. liquid) form are also suitable printing fluids.

E-jet printing process parameters include the amount of backpressure P on the ink, the applied voltage potential V across the nozzle 104 and substrate 106, and the standoff height H—i.e., the distance between the nozzle and the substrate. Other factors that can affect the ink dynamics during printing include the nozzle diameter, the type of ink material, and the type of substrate material. In operation, the pressure source ensures that ink remains present at the nozzle tip. The ink is electrically charged by the voltage applied at the nozzle. In this case, the conductive substrate is grounded, and an electrostatic field is generated between the conductive nozzle and the conductive substrate. The electrostatic forces interact with the surface tension of the ink, deforming the meniscus of the ink material into a shape known as a Taylor cone at the nozzle tip. When the electrostatic force is sufficient to overcome the surface tension of the ink, a droplet of ink is released from the nozzle and deposited onto the substrate.

The example of FIG. 1 is limited to an electrically conductive substrate, which is required to generate the electrostatic extraction field. This constraint, along with the requirement for substrate flatness (to maintain a consistent electrostatic field by maintaining a constant stand-off height H), prevents the use of a more diverse range of substrate materials, such as glass, non-conformal biological materials, and flexible materials such as polymers (e.g. for flexible electronics applications). E-jet printing systems such as that depicted in FIG. 1 can have relatively low throughput due to the single nozzle. The complexity involved with employing multiple nozzles—i.e., crosstalk of the electrostatic fields between multiple e-jet nozzles—can be problematic. Adjacent electrostatic fields generated between adjacent nozzles and the conductive substrate would overlap and change the dynamics of the ink flow when compared to a single nozzle. In addition, once a layer of non-conductive ink is deposited on the conductive substrate, the electrostatic field generated in the vicinity of the deposited ink is changed due to the changed surface conductivity of the printed substrate, thereby affecting the deposition of subsequent ink drops at or near the same location. This makes overlapping printed layers, as is required for 3-D printing, difficult to achieve.

The e-jet printing device described below does not rely on substrate conductivity and addresses many problems associated with traditional e-jet printing. The device makes it possible to print on a variety of non-conductive, flexible and/or contoured substrates and to employ multiple nozzles for higher throughput, making e-jet printing competitive with lithography techniques in some applications. The device also enables the use of a wider range of ink and substrate materials than is currently possible in ink jet printing processes.

Figure 2:
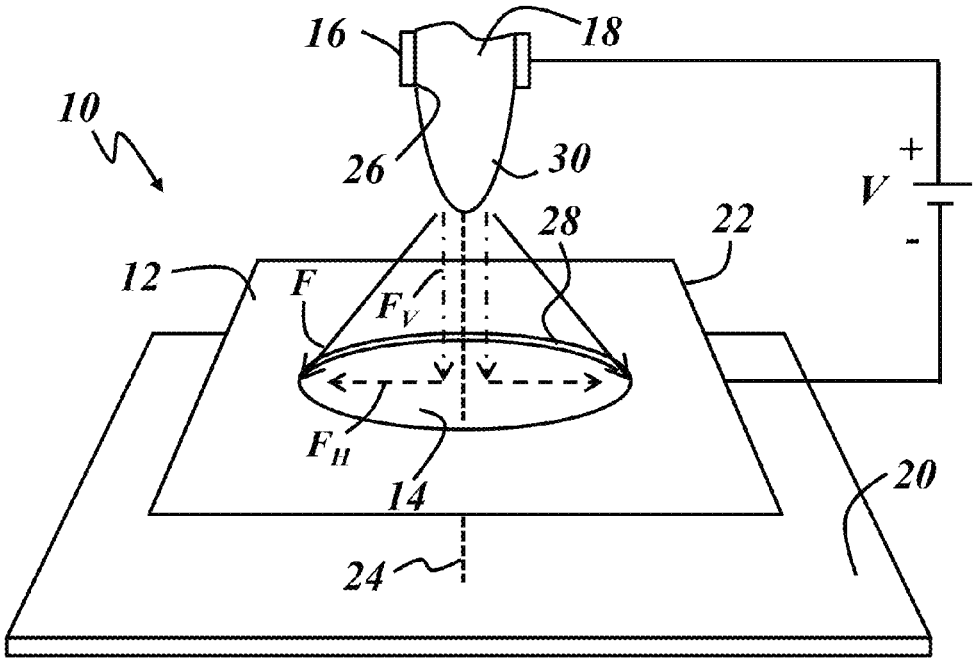
FIG. 2 is a schematic view of an embodiment of a printing device that includes an extractor with an electrically conductive layer that generates an electrostatic extraction field.

With reference to FIG. 2, an e-jet printing device 10 is illustrated schematically. In this example, the device 10 is an e-jet print head, but it should be understood that the device 10 may include other components not shown here and that the illustrated print head may be only one component of the overall device. The illustrated print head 10 includes an extractor 12, in the form of an extractor plate having an opening 14 formed through the plate, and an ink nozzle 16 arranged so that an electrostatic field is generated between the nozzle and the extractor plate when a voltage potential is applied across the nozzle and the plate. A flowable ink material or printing fluid 18 is extracted from the nozzle 16 by the electrostatic field and passes through the opening 14 to be deposited on a printing substrate 20. Thus, the electrostatic field is generated between components of the print head 10 without reliance on substrate conductivity to help generate the field.

Such a print head may be referred to as an integrated print head and reduces the effect of certain substrate characteristics (e.g., conductivity, flexibility, contour) on the ink-releasing dynamics when compared to the system of FIG. 1. For example, a non-conductive substrate 20 may be used with the e-jet print head 10 of FIG. 2. In addition, the distance or stand-off height between the nozzle 16 and the substrate 20 does not play a critical role in the printing dynamics with the e-jet print head 10 of FIG. 2, thus allowing greater flexibility in the stand-off height and accommodating e-jet printing on non-flat surfaces. The electrostatic field characteristics are unaffected by already-deposited ink, as well, accommodating 3D-e-jet.

The extractor 12 of FIG. 2 includes an electrically conductive portion or layer 22, such as copper, aluminum, gold, or indium tin oxide (ITO). The conductive layer 22 may be relatively thin, and in one example is between 25-35 μm thick. In other examples, the layer 22 may be as small as 500 nm. The opening 14 may be circular as shown with a central axis 24 oriented generally perpendicular with the extractor plate 12. In one example, the opening 14 has a diameter in a range from 30-150 μm. The nozzle 16 is electrically conductive, or has an electrically conductive portion or layer, and includes a discharge opening 26 aligned along the central axis 24 of the opening 14. The nozzle 16 may be made from an electrically conductive material, may be at least partially coated with a conductive material, and/or may include a conductive portion at the discharge opening 26. A voltage potential V can be applied across the nozzle 16 and the extractor plate 12 as shown. In one example, the conductive layer 22 is electrically grounded. With the nozzle 16 aligned along the central axis 24 of the circular opening 14 as shown, the applied voltage potential generates an electrostatic field that is symmetric about the central axis 24. At least a portion of the generated field is located between an edge 28 of the opening 14 and the nozzle 16, and some of the polarized or charged ink 18 from the nozzle is drawn into a Taylor cone 30 at the discharge opening 26. Attractive forces F act on the ink meniscus from 360 degrees with respect to the central axis 24. A majority of the radial or horizontal components $F_H$ of the attractive forces cancel each other while the axial or vertical components $F_v$ combine, resulting in a strong force in the axial direction with respect to the central axis 24. When the resulting axial force is sufficient to overcome the surface tension of the ink 18 with the nozzle 16, a droplet of ink is extracted and released from the nozzle. The axial force propels the extracted droplet through the opening 14 and onto the substrate 20

The cancellation of the radial components $F_H$ of the forces F only occurs when the nozzle 16 is aligned along the central axis 24, in this example. Misalignment of the nozzle 16 and the opening 14 results in non-symmetric radial components that will change the direction of droplet projection from axial and may result in poor printing results where axial droplet projection is relied upon. Of course, skilled artisans in possession of the present disclosure, where the electrostatic field is generated between print head components without reliance on a conductive substrate, may devise ways to use a non-symmetric field to control ink flow and/or directionality via non-concentric nozzle-opening arrangements and/or non-circular opening shapes. The opening 14 is sized so that ink droplets pass through the opening without hitting the plate 12. It may also be desirable to reduce the amount of scattering of the ink droplets that pass through the opening 14 before they reach the substrate 20, as discussed further below.

Figure 3:
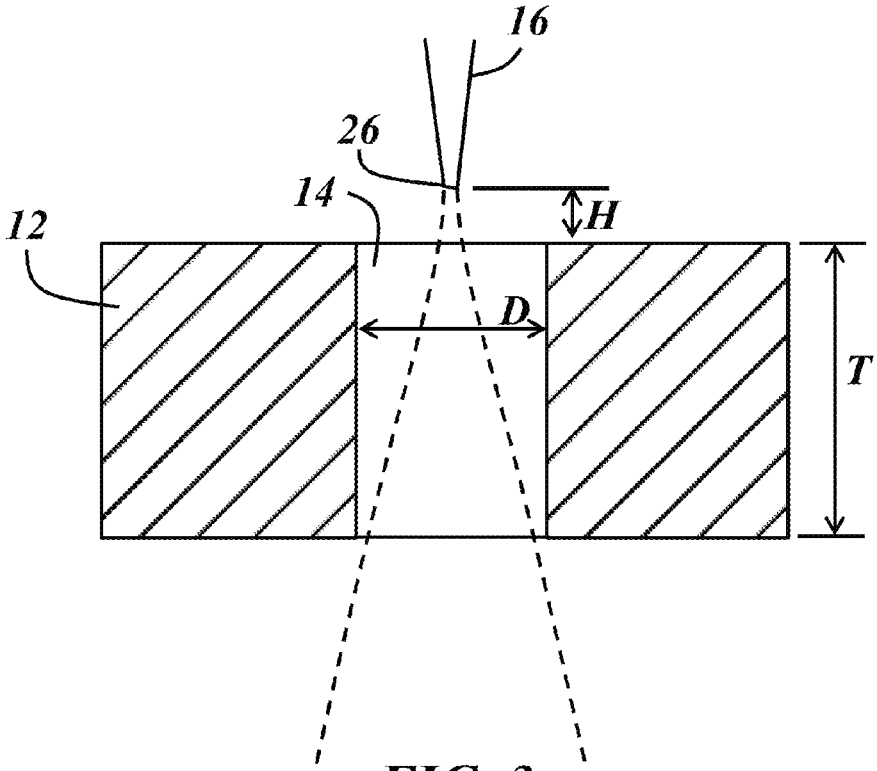
FIG. 3 is a computer simulation of printing fluid trajectory through the extractor of FIG. 2.

FIG. 3 represents a computer simulation of ink flow from the nozzle 16, through the opening 14 of the extractor plate 12, and toward the printing substrate. In this simulation, the extractor plate 12 is modeled as a layer of copper material with a thickness of T=80 μm. The voltage potential across the nozzle 16 and extractor plate 12 is 400V, with the extractor plate electrically grounded. The offset height is H=15 μm, and the diameter of the opening 14 is D=60 μm. The distal end of the nozzle 16 has an outer diameter of 3.6 μm, and the discharge opening 26 has an inner diameter of 2 μm. The overall outer shape of the trajectory region, within which each of the simulated ink drops travels toward the printing substrate, is outlined by dashed lines. As shown, the majority of the ink droplets pass through the opening 14 without striking the plate 12 under the modeled conditions. This is particularly true if the generated electrostatic field results in an initial velocity of at least 10 m/s for extracted ink droplets. This simulated result has been confirmed experimentally. In the experiments, a scattering effect was observed and is indicated in the simulation by the increase in the diameter of the trajectory region below the extractor plate 12 after the ink has passed through the opening 14.

Figure 4:
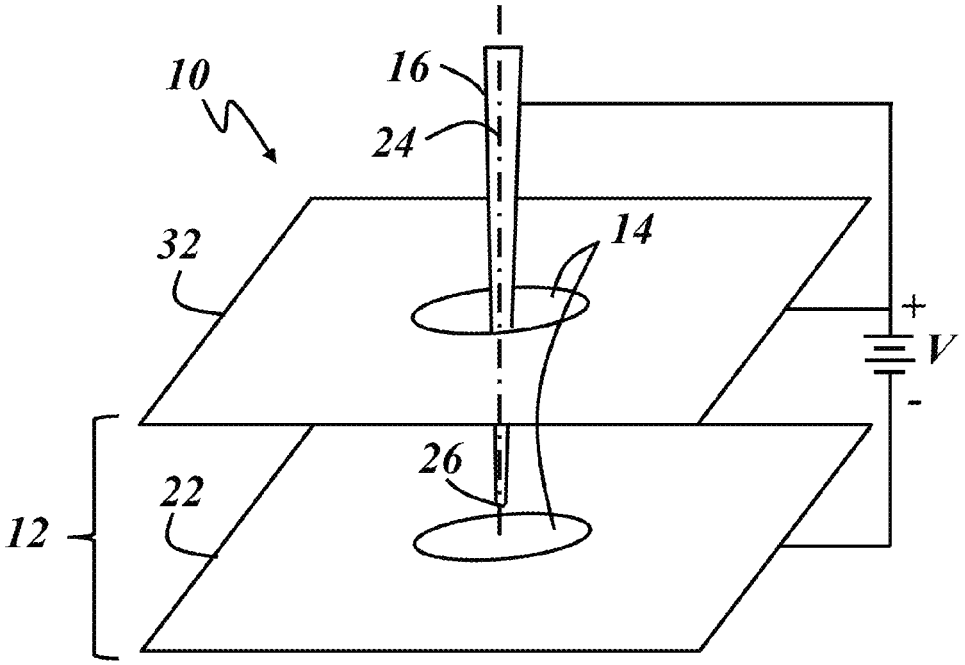
FIG. 4 is a schematic view of an embodiment of the printing device that includes an extractor with multiple electrically conductive layers.

FIG. 4 schematically illustrates another embodiment of the printing device 10. In this example, the extractor 12 is in the form of an extractor plate that includes first and second electrically conductive portions or layers 22, 32. The layers 22, 32 are generally parallel and are spaced apart in the axial direction with respect to the central axis 24. An electrically insulating or dielectric layer (not shown in FIG. 4) may be disposed between the first and second layers 22, 32. The extractor plate opening 14 extends through all of the layers of the plate 12, and the nozzle 16 extends partially through the opening. In this example, the first or bottom layer 22 is electrically grounded, and the nozzle 16 and the second or top layer 32 each have a positive voltage applied. In this case, a common positive voltage is applied to the nozzle 16 and the second layer 32, but the applied voltages could be different.

Figure 5A:
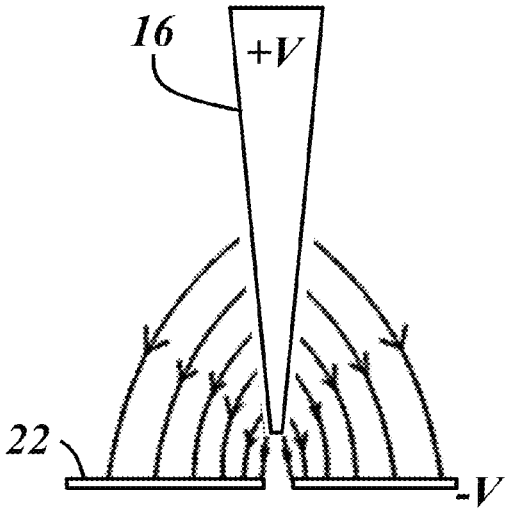
FIGS. 5A-5B are side views of a nozzle of the printing device, illustrating electrostatic field lines with a single conductive layer and with two conductive layers, respectively.
Figure 5B:
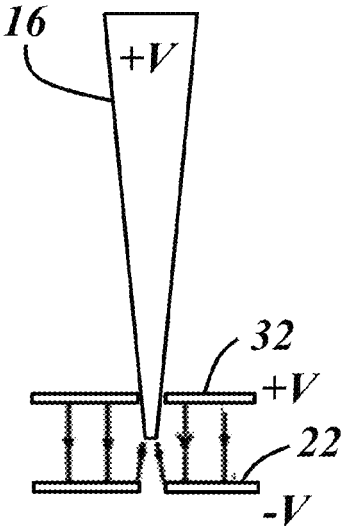

As shown in FIGS. 5A and 5B, the second conductive layer 32 reconfigures the electrostatic field generated between the nozzle 16 and the extractor plate 12 when compared to the configuration of FIG. 2. FIG. 5A illustrates exemplary electrostatic field lines surrounding the end of the nozzle without the second conductive layer, and FIG. 5B illustrates exemplary field lines in the presence of the second conductive layer. In FIG. 5B, the outer surface of the nozzle is non-conductive. The effect of the second layer 32 is that the generated electrostatic field exists primarily between the two layers 22, 32, which are the same shape, making the field generally unidirectional as shown and without the contoured field lines of FIG. 5A. The configuration of FIG. 4 thus not only eliminates the need for a conductive substrate, but also eliminates the need for a conductive nozzle. For example, only the inner surface of the nozzle 16 may be electrically conductive to charge the ink flowing therethrough. In another embodiment, the ink may be charged before it reaches the nozzle. This configuration may be particularly useful in e-jet printing with a plurality of adjacent nozzles with potential for the reduction or elimination of crosstalk between adjacent nozzles and their associated fields. This is only one example of an extractor 12 having more than one conductive layer. The extractor 12 may have any number of conductive layers, and skilled artisans may employ the concept of using multiple extractor plates and/or multiple conductive layers to manipulate the electrostatic field(s) generated in the vicinity of an e-jet or other ink jet printing nozzle in other ways.

Figure 6:
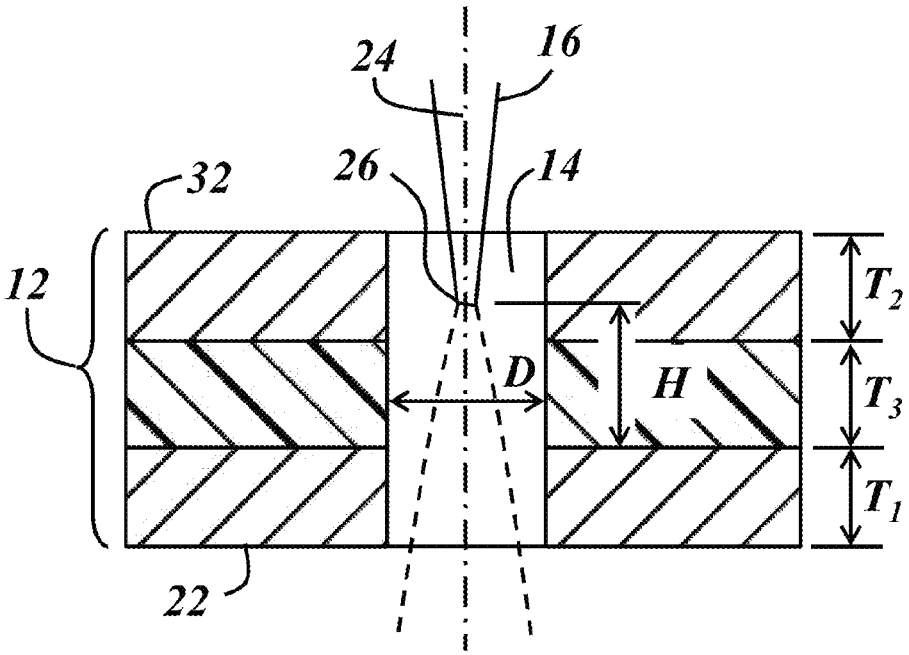
FIG. 6 is a computer simulation of printing fluid trajectory through the extractor of FIG. 4.

FIG. 6 represents a computer simulation of ink flow from the nozzle 16, through the extractor plate 12 of FIG. 4, and toward the printing substrate. In this simulation, the extractor plate 12 is modeled to include first and second electrically conductive layers 22, 32 made of copper, each having a thickness of $T_1=T_2=35$ μm. The conductive layers 22, 32 are separated by an electrically floating insulating layer having a thickness of $T_3=38.1$ μm. The voltage potential between the bottom layer 22 and each of the nozzle 16 and the top layer 32 is 400V, with the bottom layer at electrical ground. The stand-off height is about 45 μm≤H≤50 μm, and the diameter of the opening 14 is D=60 μm. The distal end of the nozzle 16 has an outer diameter of 6.65 μm, and the discharge opening 26 has an inner diameter of 5 μm. The overall outer shape of the trajectory region, within which each of the simulated ink drops travels toward the printing substrate, is outlined by dashed lines. As shown, the scattering effect indicated in the simulation of FIG. 3 is reduced by the presence of the second layer 32 and the orientation of the field lines, providing improved droplet registration and more accurate drop-on-drop printing.

Figure 7:
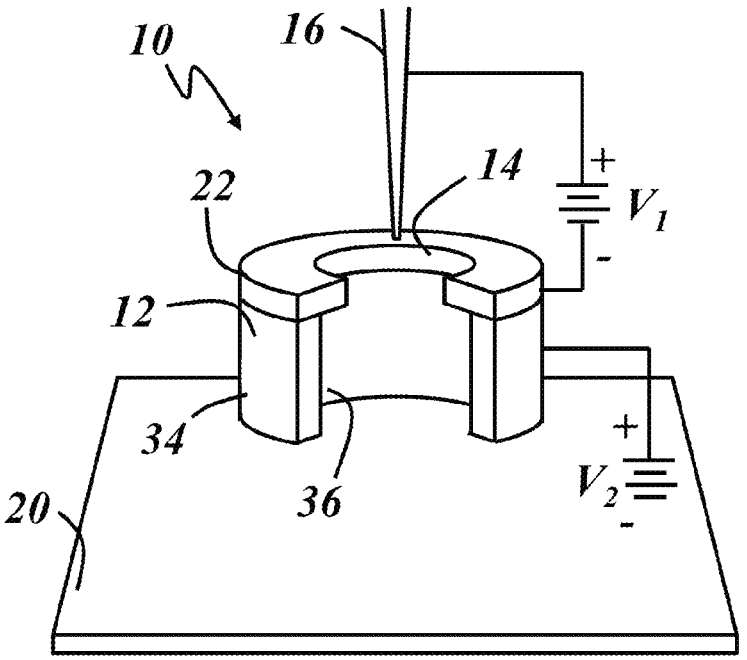
FIG. 7 is a schematic view of an embodiment of the printing device that includes a directionality unit.

The printing device 10 of FIG. 7 includes a directionality unit 34. In this example, the directionality unit 34 is integrated with the electrically conductive layer 22 as part of the extraction plate 12. The directionality unit 34 may be an electrically conductive plate or layer configured to receive an applied voltage $V_2$, which may be the same voltage or a different voltage than the voltage $V_1$ applied at the nozzle 16. In one embodiment, the voltage $V_2$ applied to the directionality unit 34 is variable. Unit 34 may function to further control the trajectory of ink droplets on the way from the nozzle 16 to the substrate 20 and may help reduce deflection errors on the printed substrate. Stated differently, the illustrated directionality unit 34 may help control or stabilize the radial position of the ink droplets passing therethrough. The thickness (i.e., the axial dimension) of the illustrated directionality unit 34 may be greater than the thickness of the conductive layer 22 to allow the electric directionality field associated with the unit to have sufficient time and distance to affect the ink trajectory. In another embodiment, the directionality unit includes a permanent magnet and the directionality field includes a magnetic field.

In the example of FIG. 7, the directionality unit 34 has an opening 36 of a different size than the opening 14 of the conductive layer 22. In the illustrated example, the opening 34 is larger than opening 14. This may help prevent scattered ink droplets entering the opening 36 from being deposited within the opening 36. The directionality unit 34 is not limited to a conductive layer or ring of material with a single applied voltage. For example, the unit 34 may include portions or segments arranged about its perimeter or about the central axis of the nozzle, with each portion adapted to receive a voltage that may be different from the voltage received by another portion. The unit 34 could include left and right halves with a voltage potential applied thereacross, or it could include a plurality of segments with alternating amounts of voltage applied to adjacent segments. Other configurations are possible. The directionality unit 34 may be employed with multiple conductive layer extraction plates as well, such as that of FIG. 4. The directionality unit 34 may also be configured to provide a directionality field that includes some other type of field that affects the direction of the printing fluid after it is extracted from the nozzle, such as an electromagnetic field or a gas flow field. Some examples of other types of directionality units and flow fields are subsequently discussed.

Figure 8:
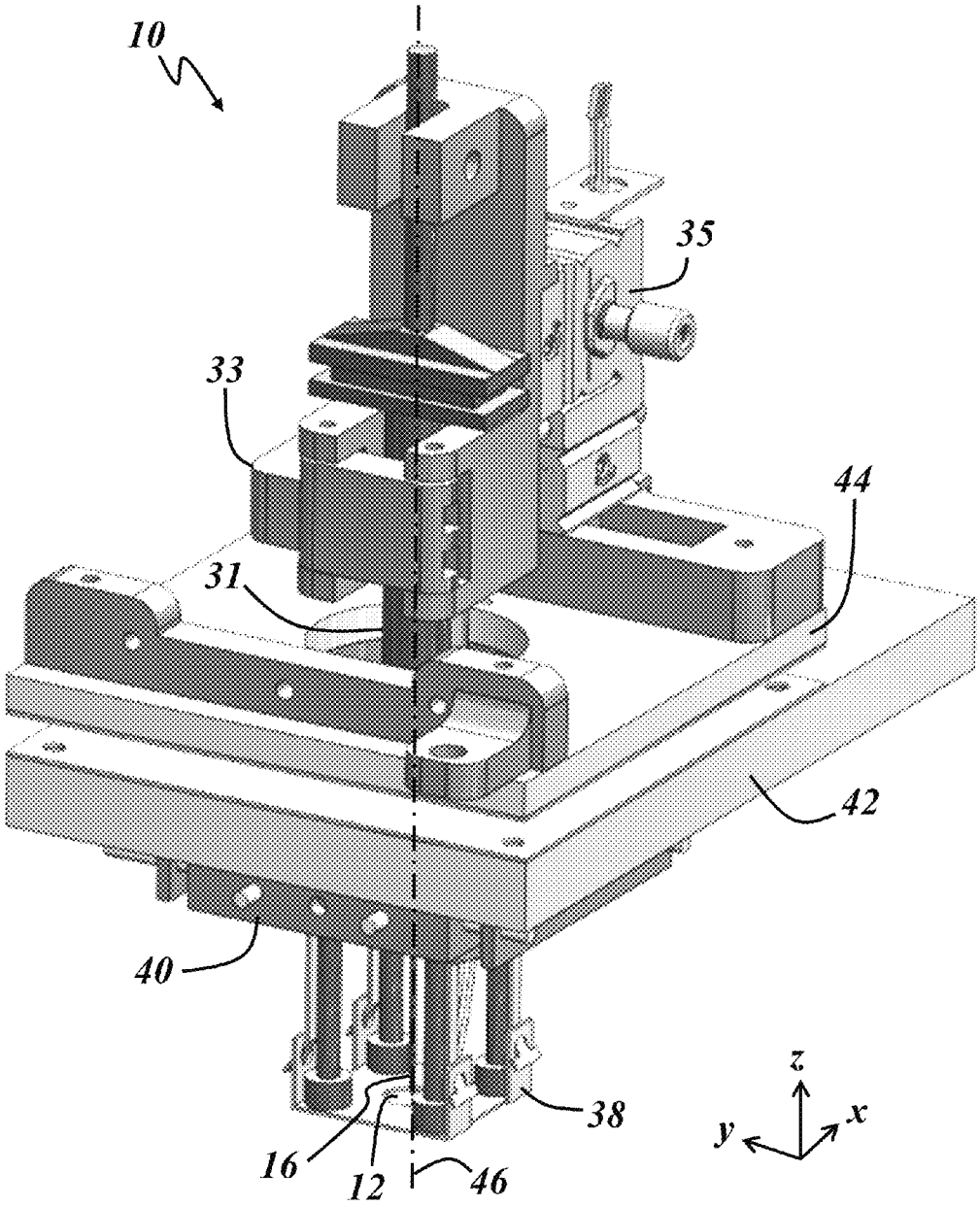
FIG. 8 is an isometric top view of an embodiment of the printing device that includes a rotational plate and translational stages.
Figure 9:
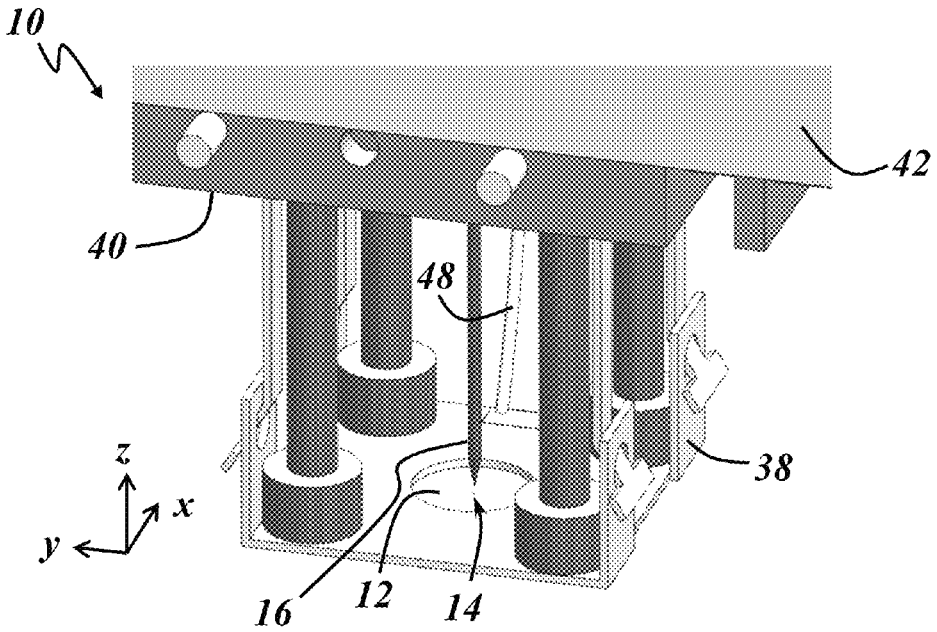
FIG. 9 is an enlarged view of a portion of the printing device of FIG. 8 showing the extractor and the nozzle.
Figure 10:
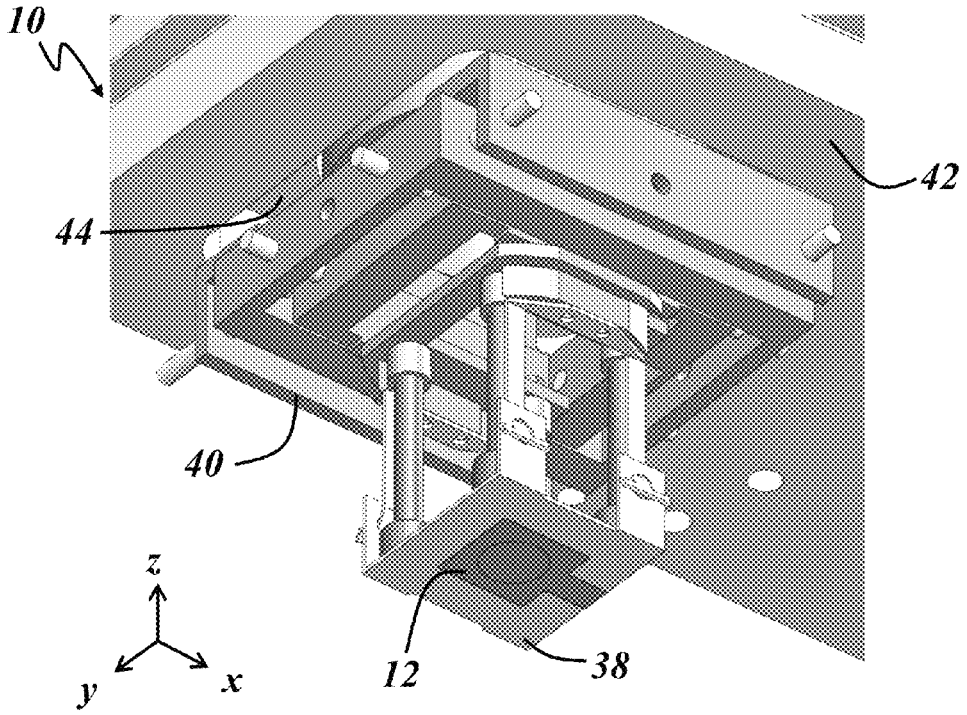
FIG. 10 is an enlarged bottom view of a portion of the printing device of FIG. 8 showing the extractor plate and XY-translational stages.
Figure 11:
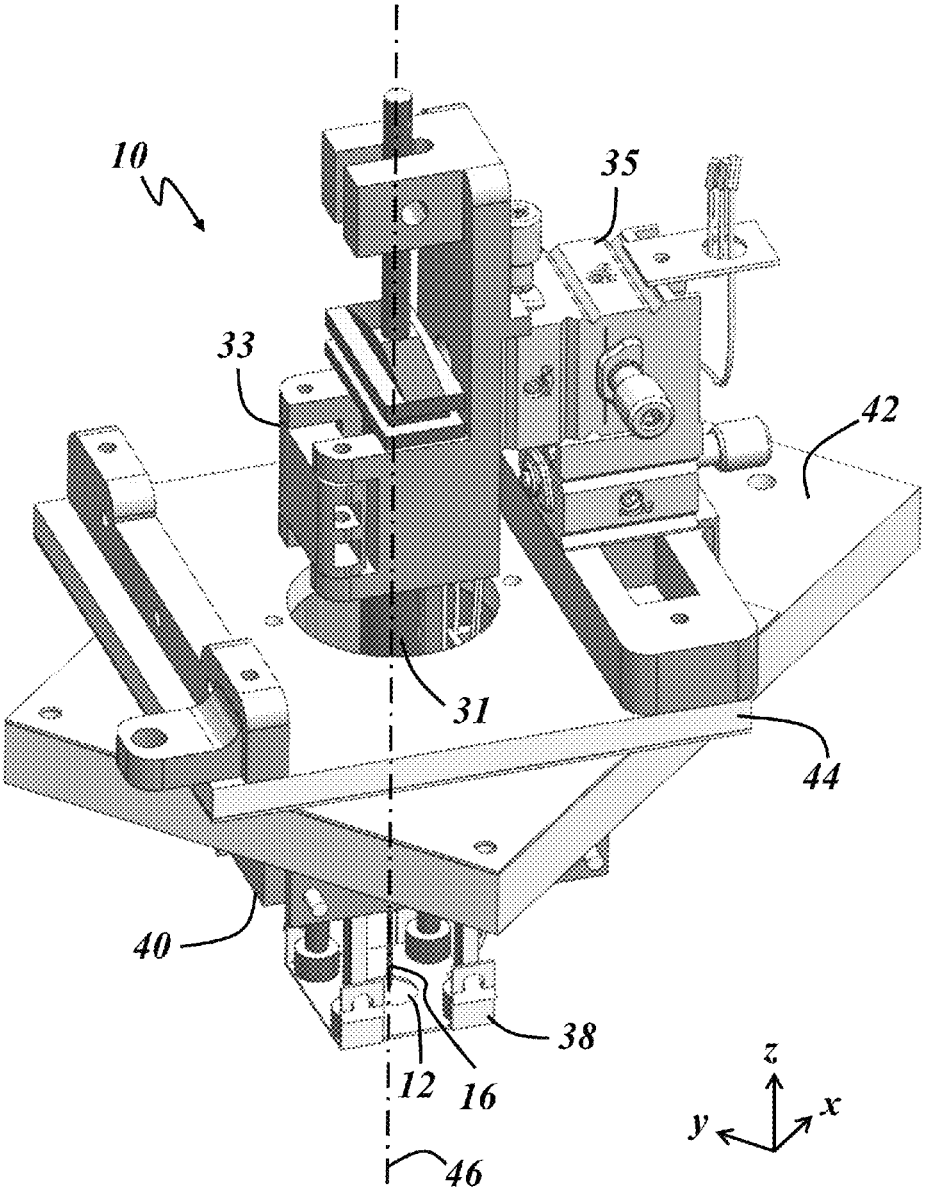
FIG. 11 is an isometric top view of the device of FIG. 8 showing the rotational plate in a rotated position.

Using a conductive surface that is part of the print head to generate the electrostatic field required for e-jet printing can presents its own challenges that are not necessarily present when a conductive printing substrate is used to generate the field. Nozzle alignment, for example, is not a factor in the operation of the e-jet printing system of FIG. 1. The scattering effect depicted in FIG. 3 is also at least partially a by-product of the presence of the above-described extractor plates. The printing device depicted in FIGS. 8-11 includes components to address some of these challenges. FIG. 8 is an isometric view of the top or ink supply side of the device, FIG. 9 is an enlarged view of the nozzle and extractor plate of FIG. 8, FIG. 10 is an enlarged isometric view of the bottom or substrate side of the extractor plate, and FIG. 11 is the isometric view of FIG. 8 with a portion of the device rotated.

The printing device 10 of FIGS. 8-11 includes an ink source 31 fluidly connected with the nozzle 16, a nozzle mount 33 that supports the ink source and the nozzle, XYZ-translational stages 35 adapted to support the nozzle mount and adjust the location of the nozzle in the x-, y-, and z-directions, an extractor mount 38 that supports the extractor 12, XY-translational stages 40 adapted to support the extractor mount and adjust the location of the extractor plate in the x- and y-directions, a support base 42, and a rotational plate 44 configured to rotate with respect to the support base about a rotational axis 46. In this particular example, the nozzle mount 33 is affixed to the rotational plate 44 via the XYZ-translational stages 35, and the extractor 12 is affixed to the rotational plate via the XY-translational stages 40 through an opening in the support base 42 so that the extractor plate and nozzle rotate together about the rotational axis 46 when the rotational plate is turned. The particular extractor 12 shown here is an extractor plate with a single conductive layer similar to that of FIG. 2, but the extractor plate(s) could include one or more additional conductive layers to affect the generated electrostatic field and/or the directionality of the ink being deposited. Other non-plate type extractors are possible, as well.

Figure 12:
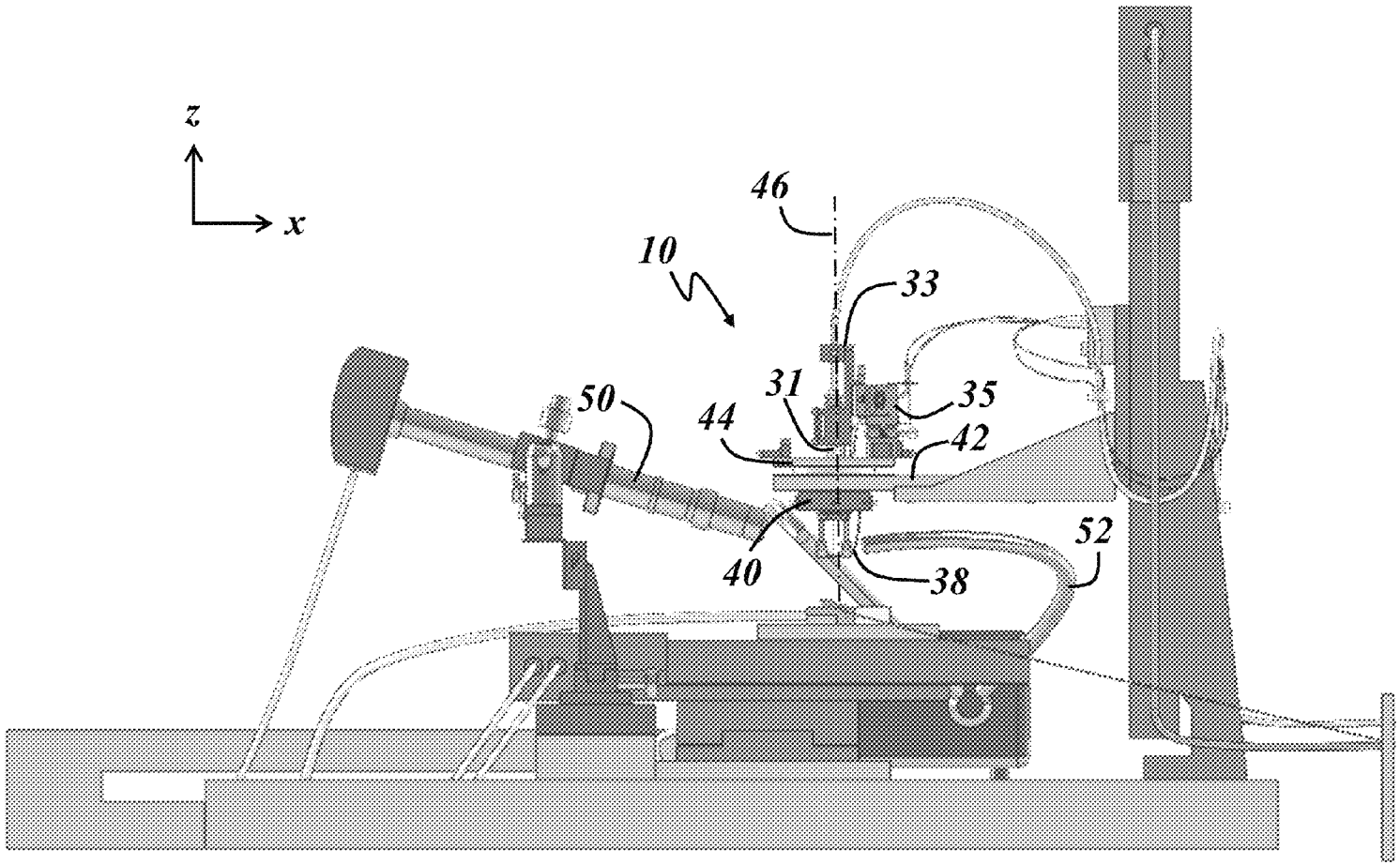
FIG. 12 is a side elevation view of an embodiment of the printing device that includes the components of FIGS. 8-11 as part of an e-jet printing system.
Figure 13:
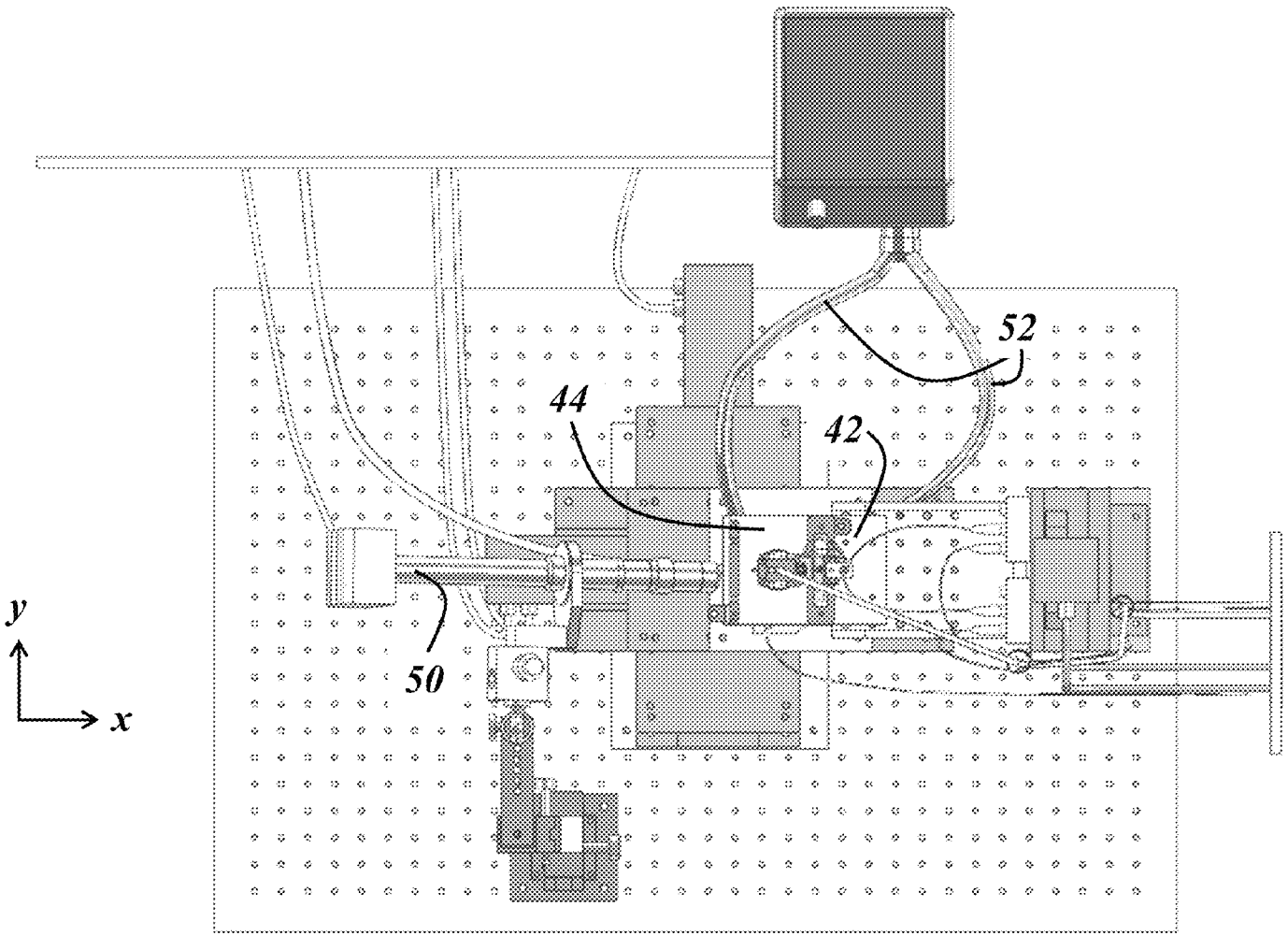
FIG. 13 is a top plan view of the device of FIG. 12.

FIG. 12 is a side elevation view of the printing device 10 in the form of an e-jet printing system that includes all of the components shown in FIGS. 8-11 together with additional components. Among the additional components is a high-resolution camera 50 and a light source 52 arranged to illuminate the printing substrate and/or the nozzle and extractor. FIG. 13 is a top plan view of the printing device 10 of FIG. 12. Other device components are labeled in FIGS. 12 and 13 consistent with the previous figures for context. The illustrated system includes other components not described in detail here, such as support frames and structures, devices for moving the substrate and print head relative to one another, electrical and plumbing connections, etc.

A working model of the printing device of FIGS. 12-13, including the components of FIGS. 8-11, has been constructed using the commercial-off-the-shelf (COTS) components listed in TABLE I. The list is non-limiting, and some of the listed components may be modified prior to use in the printing device 10. For instance, the listed micropipettes, which may be used as the nozzle 16, are glass and may be coated with a conductive material such as gold (e.g., via a sputtering process) and may also be coated with a hydrophobic coating prior to use.

TABLE I

| COTS Component | Supplier | Part No. |
|---|---|---|
| Syringe | Nordson EFD | 7012072 |
| Micropipette | World Precision | TIP2TW1-L |
| XYZ Stages | Newport | M-MT-XYZ |
| Rotational Plate | McMaster-Carr | 6031K17 |
| Support Base | McMaster-Carr | 9057K13 |

The COTS components of TABLE I were assembled as follows. The nozzle was formed from a glass micropipette ranging in diameter from 300 nm to 10 μm. The nozzle was connected to the syringe with a Luer lock. The syringe acted as the ink source or reservoir to supply the nozzle with ink. The extractor was a 30 μm copper foil with a 120 μm opening located at its center. The syringe was held in place by the nozzle mount, which was attached to the XYZ-translational stages. The XYZ-stages were attached at the top of the rotational plate, thereby enabling a user to both rotate and translate the nozzle with respect to the support base. The extractor was attached to the extractor mount with adhesive tape, and a ground wire (element 48 of FIG. 9) electrically connected the extractor with ground. The extractor mount was attached to the XY-stages via a flexible fixture. The four corners of the extractor mount were held in place with set screws which could be adjusted to change the angle of the extractor plate with respect to the central axis of the opening and/or ensure parallel alignment between the extractor plate and the printing substrate. This adjustment could also be useful for controlling directionality of the ink. The fixture was mounted to the XY-translational stages, which in turn was affixed to the rotational plate, thereby enabling the user to both rotate and translate the extractor plate with respect to the support base. With the XYZ-translational stages for the nozzle mount and the XY-translational stages for the extractor plate mounted to the same rotational plate, the nozzle and extractor plate could rotate together in the same direction with the same rotational velocity. The relative positions of the nozzle and the opening in the extractor plate could thereby be viewed from virtually all directions from a single viewpoint when the rotational plate was turned, enabling a method of using the printing device that includes the step of aligning the opening of the extractor plate with the nozzle, described further below.

For purposes of the working model, a symmetric electrostatic field as described in conjunction with FIG. 2 was desired, which necessitated proper nozzle-to-opening alignment. Given the micro-scale of both the nozzle tip and the extractor opening, the high-resolution camera was provided to visually align the two components. Aligning the nozzle and the extractor opening in both the x- and y-directions required a clear view from at least two directions. The above-described rotational plate was employed for this purpose, eliminating the need for multiple cameras and/or a camera that is moved around the print head for multiple views. A movable camera would require refocusing at each position, leading to long-set-up times and potential inaccuracies, not to mention large space requirements around the print head. The fixture required to mount a camera in more than one location could also be complex and costly, especially if more than one camera is used. Even then, the number of views is finite. The rotating feature of the working model provided an infinite number of views around the print head from a single stationary camera.

Figure 14:
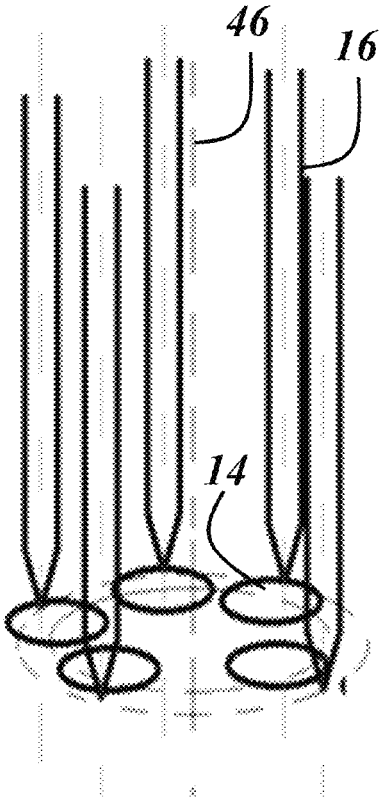
FIG. 14 illustrates a misaligned nozzle and extractor plate opening each rotating about a rotational axis.
Figure 15:
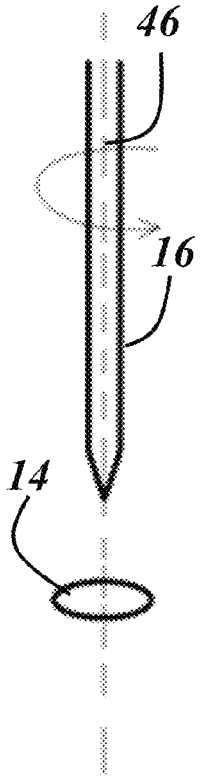
FIG. 15 illustrates an aligned nozzle and extractor plate opening rotating about the rotational axis.

As shown in FIG. 14, when a misaligned nozzle 16 and extractor plate opening 14 are rotated about the rotational axis 46 in view of the high-resolution camera, the nozzle and opening appear to rotate about the rotational axis. With the device shown in FIGS. 8-13, the nozzle and extractor plate can be adjusted independently in the x- and y-directions until they both appear stationary when rotated via the rotation plate, as shown in FIG. 15. At this stage, the nozzle and extractor plate opening are aligned with the rotational axis of the rotational plate, ensuring that the nozzle tip is aligned with the center of the opening in the extractor plate. The vertical offset between the nozzle and the extractor plate can then be adjusted using the translational z-axis on the nozzle mount. Other rotational configurations are possible. For example, in another embodiment, the device is constructed so that only the extractor plate rotates about the rotational axis, and the camera is used to observe the extractor plate opening rotating about the rotational axis. The x- and y-position of the extractor plate is adjusted until the opening appears stationary, and the nozzle is brought into alignment with the rotational axis by other means.

In order to provide consistent and steady ink-releasing dynamics in an e-jet printing system, a stable Taylor cone is maintained at the nozzle tip with a constant voltage baseline voltage. The Taylor cone formed in the presence of the electrostatic field generated with the extractor is more sensitive to the baseline voltage than when formed with a conductive substrate only. For example, a considerably higher baseline voltage may be necessary to reduce the scattering effect when an extractor is used to generate the field. But the baseline voltage must also be kept sufficiently low that the Taylor cone does not release ink droplets at the baseline voltage. Thus, unlike with conductive substrate e-jet systems, experimental optimization may be necessary to determine the maximum baseline voltage that will not cause ink droplets to be released from the Taylor cone.

With respect to the above-described working model of the printing device in operation, the deposited feature size on the substrate, in drop-on-demand printing mode, was controlled by charging the nozzle with a pulsed signal using different pulse widths. The amount of ink released, and therefore the feature size of the deposited material on the substrate, is proportional to the pulse width of the pulse signal. It was observed that the printing process demonstrated scattering behavior as the pulse width was increased beyond a threshold value. This threshold value somewhat limits the feasible feature size that can be achieved with a given nozzle diameter for a single conductive layer extractor plate. The multiple conductive layer extractor plate and/or the directionality unit described above may be effective to increase the threshold value by reducing scattering.

To print a particular pattern with the working model, a computer program (Matlab) was used to convert JPEG images into G-code files. A customized control program (LabView) then executed the G-code file and controlled both the pulsing voltage signal and the translational positioning stages. After aligning the nozzle with the central axis of the extractor plate opening as described above, the distance between the nozzle tip and the extractor plate was determined and optimized experimentally. In this case, the extractor plate was positioned approximately 30 μm above the substrate. The baseline voltage was also optimized experimentally, as noted above, to minimize scattering and to ensure sufficient Taylor cone stability.

Figure 16:
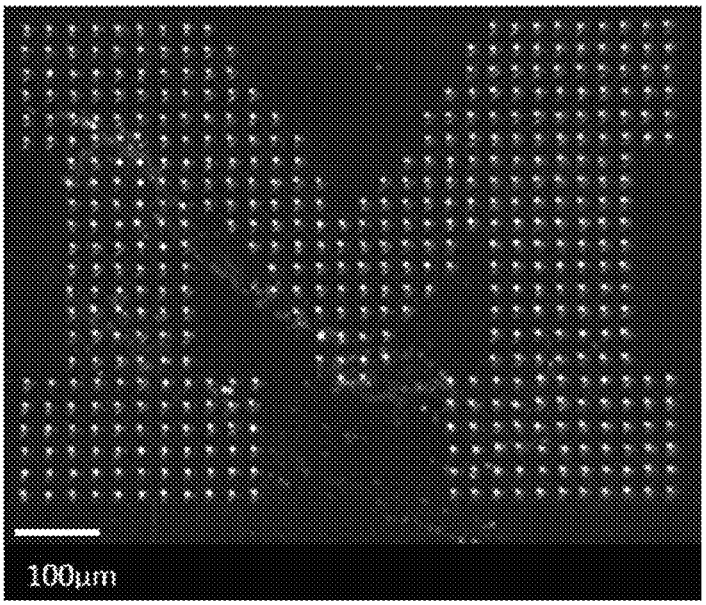
FIG. 16 is a photomicrograph of a patterned "M" logo printed on a non-conductive substrate with an embodiment of the printing device.

FIG. 16 is a photomicrograph of a University of Michigan logo printed using the above-described e-jet printing device to evaluate and demonstrate the accuracy and registration capability of the device. Table II, below, lists the printing parameters used to print the logo in FIG. 16.

TABLE II

| Parameter | Value |
|---|---|
| Pulsed High Voltage | 500 V |
| Baseline Voltage | 290 V |
| Pulse Width | 10 ms |
| Extractor Plate-to-Substrate Distance | ~30 μm |
| Extractor Plate-to-Nozzle Distance | ~20 μm |
| Ink Material | NOA 73 |
| Nozzle Diameter | 2 μm |
| Substrate Material | Glass |
| Ink Chamber Pressure | 5 psi |
| Droplet Diameter | ~7 μm |

In summary, optical adhesive NOA73 (Norland Products, Cranbury, N.J.) was successfully printed onto a non-conductive glass substrate in 7 μm droplets with a 2 μm pipette. The printing device was capable of printing smaller ink droplets, but in this case a pulse width of 10 ms was selected to create the 7 μm diameter droplets by fusing some ink drops together in order to make the printed features more visible in the relatively large logo pattern. The consistency of the droplet diameters, as well as the placement of the droplets, demonstrates the printing capability of the printing device described herein. As is apparent in FIG. 16, scattering effects were successfully mitigated through proper selection and experimental determination of the printing parameters as described above.

Figure 17:
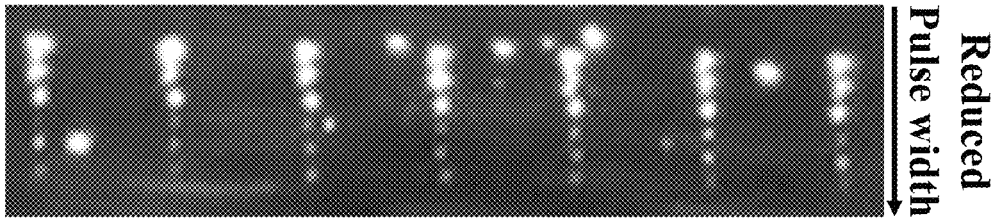
FIG. 17 is a photomicrograph of another pattern printed on a non-conductive substrate with an embodiment of the printing device, illustrating variable and controllable printed feature sizes.

FIG. 17 is a photomicrograph of another pattern printed using the described printing device. The illustrated pattern demonstrates controlled droplet resolution. The scattering effect was again minimized by optimizing the pulsed high voltage, the baseline voltage, and the offset height between the nozzle and the extractor plate. In this pattern, a matrix of dots with varying diameters was printed. The parameters used for printing the illustrated pattern are listed in Table III.

TABLE III

| Parameter | Value |
|---|---|
| Pulsed High Voltage | 400 V |
| Baseline Voltage | 240 V |
| Pulse Width (top-to-bottom in FIG. 19) | (20, 10, 5, 2, 1, and 0.5) ms |
| Extractor Plate-to-Substrate Distance | ~30 μm |
| Extractor Plate-to-Nozzle Distance | ~20 μm |
| Ink Material | NOA 73 |
| Nozzle Diameter | 2 μm |
| Substrate Material | Glass |
| Ink Chamber Pressure | 5 psi |
| Droplet Diameter | ~7 μm to ~1 μm |

In the printed pattern of FIG. 17, the pulsed high voltage and the baseline voltage are the same for all printed features, and the pulse width was varied to control the printed feature size. As indicated in Table III, the pulse width was varied from 20 ms (top row of pattern) to 0.5 ms (bottom row of pattern). The individual (vertical) columns of printed features in FIG. 17 are spaced about 30 μm apart. The droplet diameters ranged respectively from about 7 μm to about 1 μm. As shown in FIG. 17, the above-described printing device demonstrates high accuracy and feature size consistency when e-jet printing on a non-conductive substrate.

Figure 18:
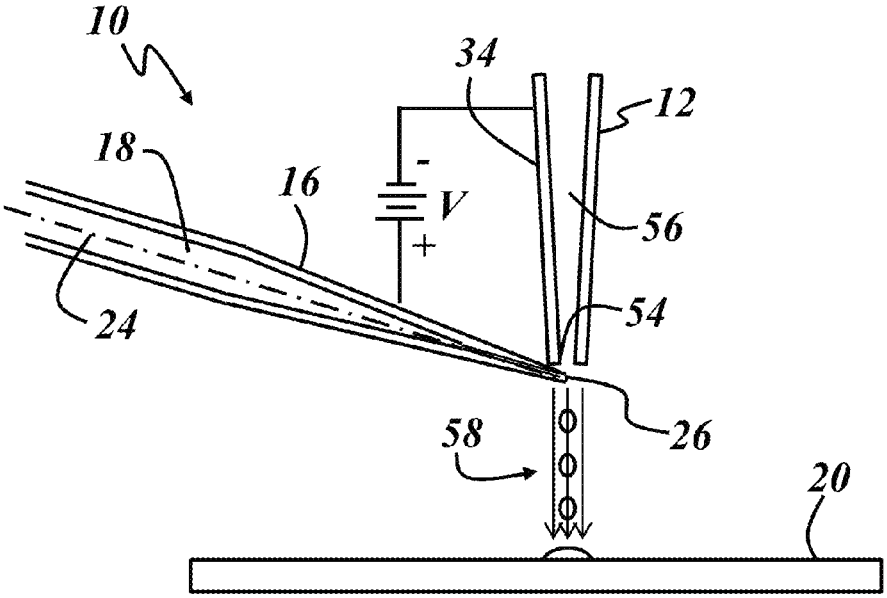
FIG. 18 is a schematic side view of an embodiment of the printing device that provides a gas flow field that directs printing fluid toward the printing substrate in a different direction than the extraction direction.

FIG. 18 schematically illustrates an embodiment of the printing device 10 in which the extractor 12 includes a gas discharge port 54 arranged to discharge pressurized gas from a fluid flow passage 56 in a direction toward the printing substrate 20 to provide a gas flow field 58 between the nozzle 16 and the printing substrate in which the extracted printing fluid travels for deposition on the printing substrate. The gas discharge port 54 and fluid flow passage 56 together at least partially define the directionality unit 34 in this embodiment. In this case, the gas flow field 58 is the directionality field that affects the direction of the printing fluid after it is extracted from the nozzle 16.

As in previous examples, the nozzle 16 of FIG. 18 is configured to provide polarized printing fluid 18 at the discharge opening 26, and the extractor 12 is configured to provide the electrostatic field at the discharge opening of the nozzle to extract the polarized printing fluid from the nozzle for deposition on the printing substrate 20 in response to an applied voltage V. The nozzle 16 and the extractor 12 are configured to move together as part of the print head 10 with respect to the printing substrate 20, and generation of the electrostatic field does not rely on substrate conductivity. Both the nozzle 16 and the extractor 12 may include an electrically conductive portion, and the voltage V is applied across the conductive portions to provide the electrostatic field. For instance, the extractor 12 and/or the nozzle 16 may be constructed from a pipette with an electrically conductive coating layer (e.g., a sputtered layer of gold) at the inner surface and/or outer surface. In some embodiments, the nozzle 16 and/or the extractor 12 are formed from an electrically conductive material. In this case, the applied voltage polarizes the printing fluid 18, but it is possible to polarize the printing fluid by other means.

The extractor 12 of the printing device 10 depicted in FIG. 18 is in the form of a nozzle. In some embodiments, the printing device 10 thus includes a plurality of nozzles 12, 16, one of the nozzles having the discharge opening 26 from which the printing fluid 18 is extracted, and another of the nozzles having the gas discharge port 54 that provides the gas flow field 58 to direct the extracted printing fluid toward the substrate 20. In the illustrated example, the extraction field is an electrostatic field generated between the conductive portions of the two nozzles 12, 16. The central or longitudinal axis 24 of the nozzle 16 from which the printing fluid is extracted is arranged at an obtuse angle with the printing substrate 20 and with the desired direction of travel of the printing fluid between the discharge opening 26 and the substrate. Also, the configuration of the electrostatic field in this example is such that the direction in which the printing fluid is extracted from the nozzle 16 has a component in the opposite direction (vertically upward in FIG. 18) from the substrate 20, because the extractor nozzle 12 is located on the opposite side of the ink nozzle from the substrate. Thus, for the resultant force acting on the extracted printing fluid to have a direction toward the substrate, the strength of the gas flow field must be sufficient to overcome—and be greater than—the net electrostatic force acting on the printing fluid in the opposite direction.

The gas discharged from the gas discharge port 54 can be air or any other suitable fluid, such as an inert gas or a gas selected to react with the printing fluid, for example. The gas may be temperature controlled to affect the printing fluid at the ink nozzle opening, or for process consistency and/or variability (i.e., viscosity control). The gas may be air with moisture control for similar reasons, or for purposes of reacting with the printing fluid. In another example, the fluid flowing through the fluid flow passage may be a volatile liquid that vaporizes upon exiting the discharge port to become the gas.

Other multi-nozzle configurations are possible, and the gas flow field 58 and/or the extraction field could be provided with other configurations. For instance, a separate nozzle could be provided to generate the gas flow field—i.e., the gas discharge nozzle does not necessarily participate in generating the electrostatic extraction field. In some of the subsequent examples, the gas discharge opening is embodied by the opening formed through the electrically conductive layer of the extractor, for example. Or one of the above-described extraction plates could be combined with a separately provided fluid flow passage and/or gas discharge port. Also, multiple printing fluid nozzles 16 could be arranged so that their respective discharge openings are located in the same gas flow field provided by a single gas discharge port.

Figure 19:
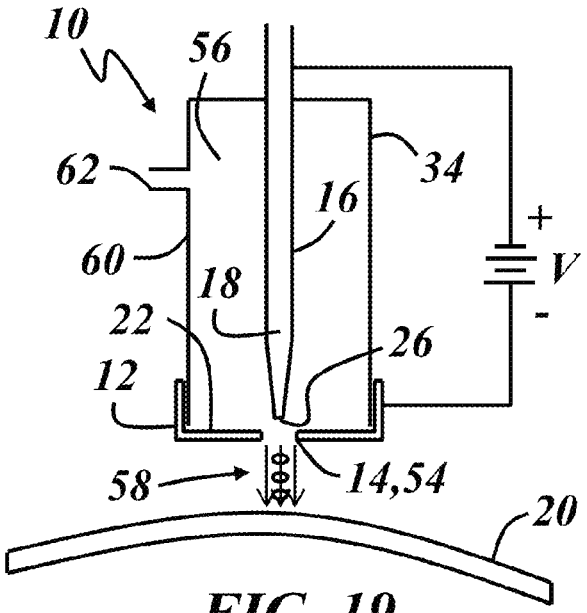
FIG. 19 is a schematic side view of an embodiment of the printing device that provides a gas flow field that directs printing fluid toward the printing substrate in the same direction as the extraction direction.

FIG. 19 schematically illustrates an embodiment of the printing device 10 in which the extraction field is provided by the extractor 12 in the form of a cap or closure that partially defines the fluid flow passage 56. A portion of the directionality field is provided by the electrostatic field generated between the extractor and the nozzle, and another portion of the directionality field is provided by the gas flow field generated between the gas discharge port 54 and the substrate 20. The net electrostatic forces acting on the extracted printing fluid are in a direction toward the printing substrate 20, which is the same direction as the net forces of the gas flow field 58. In this particular example, the fluid flow passage 56 is defined at least in part by surfaces of a chamber housing 60, the nozzle 16, and the extractor 12. A fluid inlet port 62 is provided to receive fluid for the fluid flow passage. The extractor 12 has a conductive portion or layer 22, or is made from a conductive material, and operates similar to the extractor plate of FIG. 2 via the opening 14 formed through the extractor. In this embodiment, the opening 14 of the extractor 12 and the gas discharge port 54 of the directionality unit 34 are one and the same. The extractor 12 in this example may be considered to include an extractor plate with a flange at its perimeter to form the cap shape, and the flange does not necessarily include a conductive portion.

Figure 20:
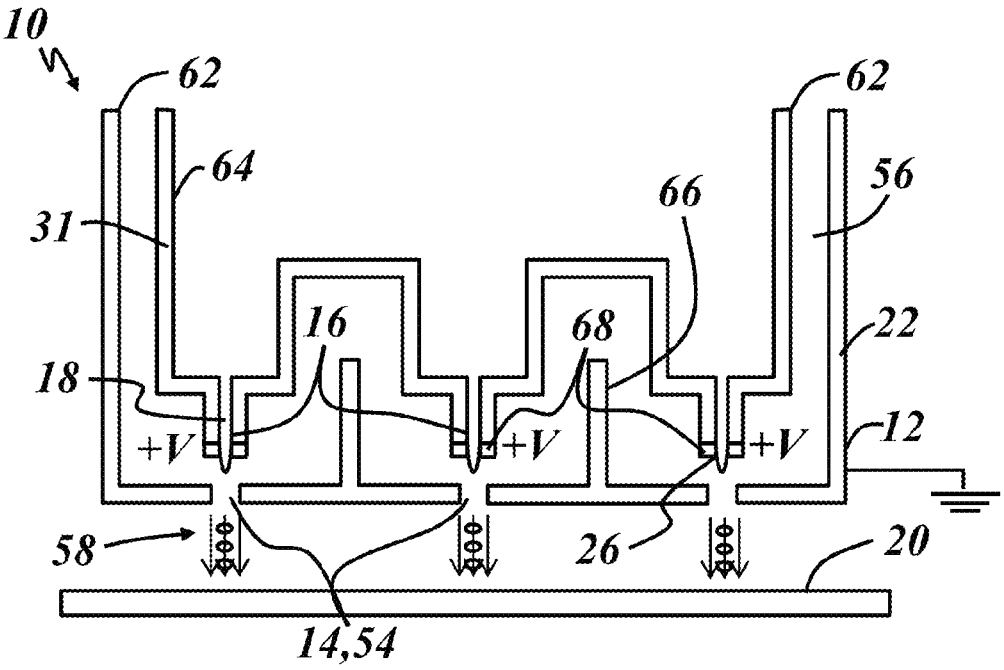
FIG. 20 is a schematic side view of an embodiment of the printing device that includes a plurality of nozzles and gas discharge ports.

FIG. 20 schematically illustrates an embodiment of the printing device 10 including a plurality of nozzles 16 with an extractor 12 that has a corresponding plurality of openings 14 through which the printing fluid travels from the discharge opening 26 of each nozzle to the substrate 20. A plurality of extraction fields are provided by the extractor 12, which also partially defines the fluid flow passage 56 between a pair of fluid inlet ports 62 and the gas discharge ports 54. Here again, the openings 14 of the extractor 12 serve as the gas discharge ports 54 at which the gas flow fields 58 are provided as directionality fields for the extracted printing fluid. A portion of each directionality field is provided by the electrostatic field generated between the extractor and each nozzle, and another portion of each directionality field is provided by the gas flow field generated between each gas discharge port 54 and the substrate 20.

In this particular example, the fluid flow passage 56 is defined at least in part by surfaces of the extractor 12, the nozzles 16, and a housing 64 of the printing fluid reservoir 31. The extractor 12 has a conductive portion or layer 22, or is made from a conductive material, and operates similar to the extractor plate of FIG. 19 via the openings 14 formed through the extractor. The extractor 12 in this example may be considered to include an extractor plate with a flange at its perimeter to form the cap shape, and the flange does not necessarily include a conductive portion. The extractor 12 of FIG. 20 also includes shields 66 located between adjacent nozzles 16 and extractor openings 14. The shields 66 are electrically conductive or have an electrically conductive portion or layer to help isolate the adjacently generated electrostatic fields at each nozzle 16 and corresponding opening 14.

Another feature of the example of FIG. 20 that can help reduce the presence of extraneous electric fields is the configuration of the electrically conductive portion 68 of each nozzle 16. In this example, only a ring-shaped portion of each nozzle 16 is electrically conductive, with the remainder of each nozzle and the housing 64 of the printing fluid reservoir 31 being formed from an electrically insulating material. The discharge opening 26 of each nozzle 16 is formed at the conductive portion 68 of each nozzle. The applied voltage V in this example is applied commonly across the plurality of conductive rings 68 and the extractor 12, which is grounded in this example. It is also possible to apply a different voltage to each nozzle 16 in this embodiment.

Consistent with the above-described embodiments of the printing device, a method of printing may include the step of extracting polarized printing fluid from the nozzle of the print head and the step of providing a directionality field to propel the extracted printing fluid toward the printing substrate. Using the above-described printing device, the extraction step can be performed by applying a voltage across two different and/or electrically isolated components of the print head to generate an electrostatic extraction field between the two components sufficient to extract the polarized fluid. Multiple combinations of the printing device features described above can be employed to practice this method, including but not limited to single conductive layer extraction plates, multi-layer extraction plates, multiple nozzle configurations (e.g., multiple ink nozzles and/or multiple gas discharge nozzles), directionality units and/or fields (e.g. gas flow fields, electric fields, magnetic fields, etc.), shielding between adjacent nozzle, etc. The method can be performed where the printing substrate is non-conductive, contoured, flexible, or any combination thereof. The directionality field may be no more than the electrostatic field generated between the isolated components of the print head, or it may include that electrostatic field in addition to one or more other fields that affect droplet trajectory. The directionality field may include a gas flow field, a separately provided electric field and/or magnetic field, or the resultant combination of any of these types of fields.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

The invention claimed is:

1. A printing device, comprising:

a nozzle having a discharge opening and being configured to provide polarized printing fluid at the discharge opening;

an extractor that provides an electrostatic extraction field at the discharge opening that extracts the polarized printing fluid from the nozzle through the discharge opening in an extraction direction for deposition on a printing substrate in response to an applied voltage, wherein the nozzle and the extractor are configured to move together with respect to the printing substrate; and a directionality unit configured to provide at least a portion of a directionality field in addition to the electrostatic extraction field, wherein the directionality field affects the direction of the printing fluid after it is extracted from the nozzle, wherein the directionality unit comprises a gas discharge port separate from the nozzle discharge opening, the gas discharge port being arranged to discharge a flow of gas in a direction toward the printing substrate to provide a gas flow field between the nozzle and the printing substrate in which the extracted printing fluid travels for deposition on the printing substrate, wherein the directionality field includes the gas flow field and is configured to cause the extracted printing fluid to travel in the direction of discharge of the gas from the gas discharge port independent of the extraction direction.

2. A printing device as defined in claim 1, wherein each of the nozzle and the extractor comprises an electrically conductive portion, the voltage being applied across said electrically conductive portions to provide the electrostatic extraction field and to polarize the printing fluid.

3. A printing device as defined in claim 1, wherein the extractor comprises an electrically conductive layer having an opening formed therethrough and located so that extracted printing fluid passes through the opening in the electrically conductive layer for deposition on the printing substrate.

4. A printing device as defined in claim 1, wherein the extractor comprises first and second electrically conductive layers with coaxial openings formed through each of the electrically conductive layers, the voltage being applied across the first and second electrically conductive layers and the extractor being located so that extracted printing fluid passes through at least one of said coaxial openings for deposition on the printing substrate.

5. A printing device as defined in claim 4, wherein the voltage is additionally applied across the nozzle and one of the electrically conductive layers so that the nozzle is at the same potential as the other one of the electrically conductive layers.

6. A printing device as defined in claim 1, wherein the at least a portion of the directionality field provided by the directionality unit comprises an electric field and/or a magnetic field between the nozzle and the printing substrate through which the extracted printing fluid travels for deposition on the printing substrate.

7. A printing device as defined in claim 1, wherein the extractor comprises the gas discharge port.

8. A printing device as defined in claim 1, wherein the discharge opening lies along a longitudinal axis of the nozzle and the longitudinal axis is arranged at an obtuse angle with respect to a direction of travel of the printing fluid toward the printing substrate.

9. A printing device as defined in claim 1, wherein the nozzle and the extractor are arranged so that the electrostatic extraction field extracts the polarized printing fluid from the nozzle in a direction different from a direction of travel of the printing fluid toward the printing substrate.

10. A printing device as defined in claim 1, wherein the extractor, the nozzle, or each of the extractor and the nozzle is rotatable about a rotational axis.

11. A printing device as defined in claim 1, wherein the location of the nozzle with respect to the extractor is adjustable in at least one direction.

12. A printing device as defined in claim 1 comprising a plurality of nozzles, each one of the nozzles having a discharge opening and being configured to provide polarized printing fluid at the discharge opening, wherein an electrostatic extraction field is provided at each of the discharge openings that extracts the polarized printing fluid from each nozzle for deposition on the printing substrate in response to the applied voltage.

13. A printing device as defined in claim 12, wherein the extractor comprises an electrically conductive layer having a plurality of openings formed therethrough so that printing fluid from each one of the nozzles passes through a corresponding one of the openings in the electrically conductive layer for deposition on the printing substrate.

14. A printing device as defined in claim 13 configured to generate a directionality field between the discharge opening of each nozzle and the printing substrate that helps direct the extracted printing fluid toward the printing substrate.

15. A printing device as defined in claim 12, further comprising a shield extending between adjacent nozzles to help isolate the electrostatic fields at adjacent discharge openings.

16. A printing device as defined in claim 1, wherein the extractor is spaced apart from the nozzle as a separate component.

17. A printing device as defined in claim 1, wherein the nozzle and the extractor are arranged so that the electrostatic extraction field extracts the polarized printing fluid from the nozzle in a direction having a component in a direction opposite a direction of travel of the printing fluid toward the printing substrate.

18. A printing device as defined in claim 1, wherein the directionality unit comprises a fluid flow passage along which the gas discharged at the gas discharge port is pressurized prior to discharge, and wherein the printing fluid is separately pressurized by a backpressure that ensures that printing fluid remains present at the nozzle discharge opening for extraction by the extractor.

* * * * *